US007914331B2

(12) United States Patent
Hetzer et al.

(10) Patent No.: US 7,914,331 B2
(45) Date of Patent: Mar. 29, 2011

(54) PLUG CONNECTOR FOR TELECOMMUNICATIONS AND DATA TECHNOLOGY

(75) Inventors: Ulrich Hetzer, Berlin (DE); Frank Mössner, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/376,013

(22) PCT Filed: Jul. 18, 2007

(86) PCT No.: PCT/EP2007/006363

§ 371 (c)(1),
(2), (4) Date: Feb. 2, 2009

(87) PCT Pub. No.: WO2008/014891

PCT Pub. Date: Feb. 7, 2008

(65) Prior Publication Data

US 2010/0003861 A1 Jan. 7, 2010

(30) Foreign Application Priority Data

Aug. 4, 2006 (DE) ..... 10 2006 036 459

(51) Int. Cl.
*H01R 13/719* (2006.01)

(52) U.S. Cl. ..... 439/620.05

(58) Field of Classification Search ..... 439/620.17, 439/620.15, 620.21, 620.05, 620.11
See application file for complete search history.

(56) References Cited

U.S. PATENT DOCUMENTS 5,069,641 A * 12/1991 Sakamoto et al. ..... 439/620.22
5,456,619 A * 10/1995 Belopolsky et al. ..... 439/620.07
5,587,884 A * 12/1996 Raman ..... 439/620.17
5,628,653 A * 5/1997 Haas et al. ..... 439/607.04
5,766,043 A * 6/1998 Talend ..... 439/676
5,872,492 A * 2/1999 Boutros ..... 439/620.09
5,971,813 A * 10/1999 Kunz et al. ..... 439/676
6,062,908 A * 5/2000 Jones ..... 439/620.07
6,102,741 A * 8/2000 Boutros et al. ..... 439/620.06
6,276,943 B1 * 8/2001 Boutros et al. ..... 439/76.1
6,302,741 B1 10/2001 Fasold et al.
6,319,064 B1 * 11/2001 Belopolsky et al. ..... 439/620.19
6,579,116 B2 * 6/2003 Brennan et al. ..... 439/418
6,663,411 B2 * 12/2003 Little ..... 439/352
6,837,732 B2 * 1/2005 Pavlovic et al. ..... 439/620.05
6,926,558 B2 * 8/2005 Sasai et al. ..... 439/620.04
6,953,362 B2 10/2005 Mossner et al.
7,348,862 B1 * 3/2008 Norte ..... 439/620.05

FOREIGN PATENT DOCUMENTS

DE 41 03 321 8/1991
DE 195 00 295 7/1996

(Continued)

*Primary Examiner* — Briggitte R Hammond

(74) *Attorney, Agent, or Firm* — Merchant & Gould P.C.

(57) ABSTRACT

The invention relates to a plug connector (1) for telecommunications and data technology, for connection of a balanced data cable, with the plug connector (1) having an electrically insulating plug connector housing (2) as well as first contacts (8) and second contacts (7), with the first contacts making contact with a plurality of conductor pairs in a balanced data cable, and with the second contacts being able to make electrical contact with the contacts of a complementary plug connector, with in each case two first contacts being associated with one conductor pair and with each first contact being associated with one second contact, with the first contacts being galvanically connected to their associated second contacts, and with all the conductor pairs each being associated with a common-mode filter arrangement.

19 Claims, 5 Drawing Sheets

FOREIGN PATENT DOCUMENTS

| | | |
|---|---|---|
| DE | 197 04 317 | 9/1997 |
| DE | 298 19 314 | 4/2000 |
| EP | 0 844 697 | 5/1998 |
| WO | WO 97/47083 | 12/1997 |
| WO | WO 02/15339 | 2/2002 |
| WO | WO 2006/078760 | 7/2006 |

* cited by examiner

PLUG CONNECTOR FOR TELECOMMUNICATIONS AND DATA TECHNOLOGY

This application is a National Stage Application of PCT/EP2007/006363, filed Jul. 18, 2007, which claims benefit of Ser. No. 10 2006 036 459.7, filed Aug. 4, 2006 in Germany and which application(s) are incorporated herein by reference. To the extent appropriate, a claim of priority is made to each of the above disclosed applications.

The invention relates to a plug-in connector for telecommunications and data technology.

Such plug-in connectors are, for example, RJ45 sockets or plugs, such a generic RJ45 socket being described in WO 02/15339.

Furthermore, DE 298 19 314 U1 has disclosed a socket-type plug-in connector having a dielectric plug-in connector housing and contacts arranged in the plug-in connector housing for the purpose of producing a connection with the contacts of an associated plug-in connector which has been inserted into an insertion opening in the plug-in connector housing, and having external connection contacts for the purpose of producing an electrical connection with the socket-type plug-in connector, having an arrangement for the purpose of DC-decoupling the contacts for the associated plug-in connector from the external connection contacts and having a filter device, an element being provided which can be inserted essentially completely into the plug-in connector housing and holds both the contacts for the associated plug-in connector and the external connection contacts, and in which both the arrangement for the DC-decoupling and the filter device are arranged. The arrangement for the DC-decoupling and the filter device comprise inductances which are formed by coils having a ferrite ring core, whose center axes are aligned in each case parallel to one another. Transformers for the DC-decoupling act as a bandpass filter, which is disadvantageous in particular in the case of broadband transmissions in accordance with CAT6 and 10 gigabit/s Ethernet applications.

In the case of CAT6 or 10 gigabit/s Ethernet applications, in addition to the known crosstalk effects within a plug-in connector, such as NEXT (near end crosstalk) and FEXT (far end crosstalk), there is an increased influence of the so-called ANEXT (alien near end crosstalk) or AFEXT (alien far end crosstalk) in adjacent plug-in connectors. The influence of the ANEXT or AFEXT increases severely at higher signal transmission rates. This AXT (alien crosstalk) comprises the direct AXT between the plug-in connectors and the indirect AXT via the differential mode to common mode conversion of the plug-in connector, the common-mode coupling between the connected cables and the common mode to differential mode conversion in the plug-in connector which is subjected to the interference.

The invention is therefore based on the technical problem of providing a plug-in connector for telecommunications and data technology, by means of which the influence of the AXT is reduced at high transmission rates of CAT6 or 10 gigabit/s Ethernet.

In this regard, in each case one common-mode filter arrangement is assigned to all of the core pairs. An interfering common-mode signal is thereby attenuated in pairs, with the result that this attenuated common-mode component does not lead to AXT in an adjacent plug-in connector. At the same time, the common-mode filter arrangement also attenuates injected common-mode signals from other plug-in connectors.

In one preferred embodiment, the common-mode filter arrangement is in the form of a common-mode inductor, which is arranged on a printed circuit board for the first and second contacts, the common-mode inductor preferably being in the form of an SMD component, which allows for a compact design. The common-mode inductor is in this case preferably electrically connected between the first and second contacts.

As an alternative or in addition, the common-mode arrangement can be in the form of a ferrite sleeve, a dedicated ferrite sleeve being assigned to each core pair, whereas an individual ferrite sleeve would have virtually no effect for the entire cable. The reason for this is the fact that the common-mode signals on the different core pairs do not necessarily have the same direction. The common-mode interference therefore needs to be reduced separately for each core pair.

Various embodiments are now possible for connecting the ferrite sleeves to the plug-in connector or the plug-in connector housing.

In one embodiment, the ferrite sleeves are in the form of a separate component and are fixed, for example latched or adhesively bonded, to the plug-in connector housing. In addition it is also possible to provide a separate ferrite sleeve holder which holds the ferrite sleeves, the ferrite sleeve holder itself being held by the housing of the plug-in connector or the cores. In this case, the ferrite sleeve holder is preferably designed such that the individual ferrite sleeves do not come into contact with one another and therefore magnetic couplings are avoided. In addition to the actual plug-in connector housing, the ferrite sleeves can also be arranged on a cable manager of the plug-in connector.

In one alternative embodiment, the plug-in connector housing and/or a retainer and/or a cable manager consists at least partially of a ferrite material or contains ferrite material. It is thus possible, for example, for a cable manager to consist completely of a ferrite material, the core pairs then being passed through said cable manager in their respectively associated segment. As an alternative, the ferrite sleeves can be encapsulated by injection molding in the plug-in connector housing. It is also possible to admix ferrite powder to the plastic injection molding material.

A common-mode filter arrangement preferably takes place in the case of a plug-in connection both on the plug side and on the socket side, but the respective design of the common-mode filter arrangement may be different.

The invention will be explained in more detail below with reference to a preferred exemplary embodiment. In the figures.

Figure 2:
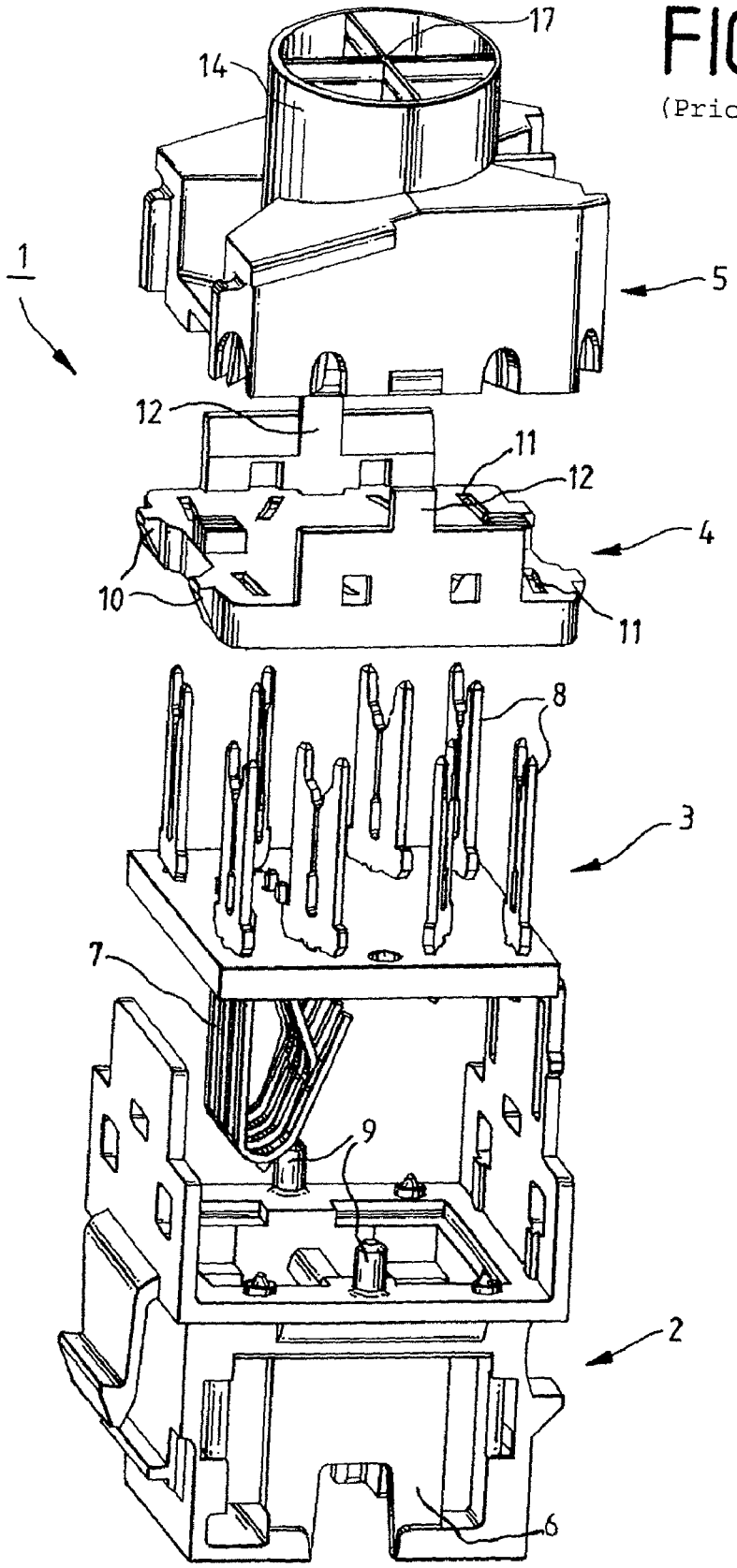
FIG.2 (Prior Art)
FIG. 2 shows an exploded illustration of a plug-in connector (prior art)

FIG. 2 shows an exploded illustration of a plug-in connector 1. The plug-in connector 1 comprises a plug-in connector housing 2, a printed circuit board 3, a retainer 4 and a cable manager 5. In the example illustrated, the plug-in connector housing 2 is in the form of a socket housing having various latching and insertion means. The plug-in connector housing 2 is formed with a shielding plate 6 on the side faces. The printed circuit board 3 is populated with a set of second contacts 7 on its front side and with a set of first contacts 8 on its rear side, said first contacts 8 being in the form of insulation displacement contacts. In each case one contact 7 is connected to a contact 8. The printed circuit board 3 is then inserted into the plug-in connector housing 2. In the process, cylinder pins 9 of the plug-in connector housing 2 pass through holes in the printed circuit board 3, with the result that the plug-in connector housing 2 and the printed circuit board 3 are adjusted and fixed with respect to one another. The contacts 7 in the form of RF contacts then protrude into an opening which is accessible from the front side of the plug-in connector housing. Then, the retainer 4 is pushed over the contacts 8 of the second set and latched to the plug-in connector housing 2. For this purpose, the retainer 4 is formed with latching tabs 10 on the end side and has continuous openings 11 for the insulation displacement contacts 8. Furthermore, the retainer 4 is formed with two latching hooks 12, which serve the purpose of latching with a cable manager 5. The cable manager 5 is essentially square and has an opening in the center, around which a cylindrical attachment 14 is arranged. The opening extends from the rear side continuously to the front side, a guide cross 17 being arranged in the opening and dividing the opening into four segments. In this case, an associated core pair of a data cable is guided in each segment. As regards the further design of the plug-in connector, express reference is hereby made to WO 02/15339.

Figure 1:
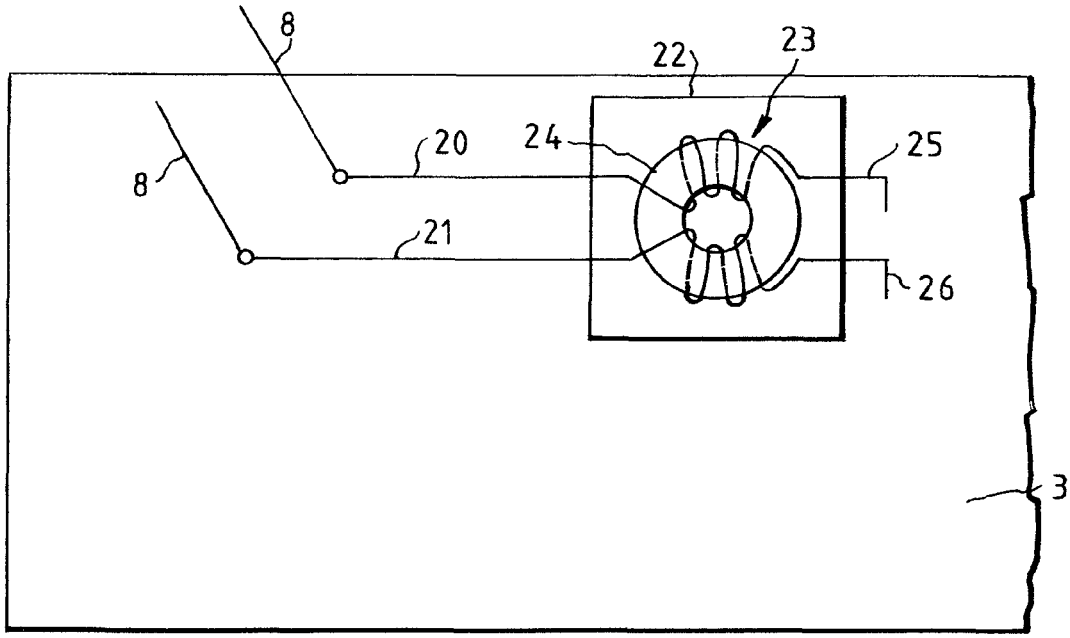
FIG. 1 shows a schematic illustration of a common-mode inductor on a printed circuit board for the first and second contacts.

FIG. 1 now shows a schematic illustration of a first embodiment of the common-mode filter arrangement for a plug-in connector shown in FIG. 2. Two associated insulation displacement contacts 8 are illustrated on the printed circuit board 3, by means of which contacts 8 contact is made with the cores of a core pair. The two insulation displacement contacts 8 are electrically connected to an SMD component 22 via in each case one conductor track 20, 21, said SMD component 22 comprising a common-mode inductor 23 having a ferrite ring 24. The SMD element 22 is connected to the associated RF contacts 7 on the other side of the printed circuit board 3 via conductor tracks 25, 26 and through-platings (not illustrated). As a result, the common-mode signal on the core pair is reduced in pairs, with the result that this core pair represents a lesser interference source for adjacent plug-in connectors. In the exemplary embodiment illustrated, the common-mode inductor 23 is illustrated only for one core pair. It goes without saying that, in the case of an RJ45 socket as shown in FIG. 2, four common-mode inductors 23 are used for the four core pairs. Alternatively, the plug-in connector housing 2 or the retainer 4 and/or the cable manager 5 may also consist of ferrite material or contain ferrite material.

Figure 3:
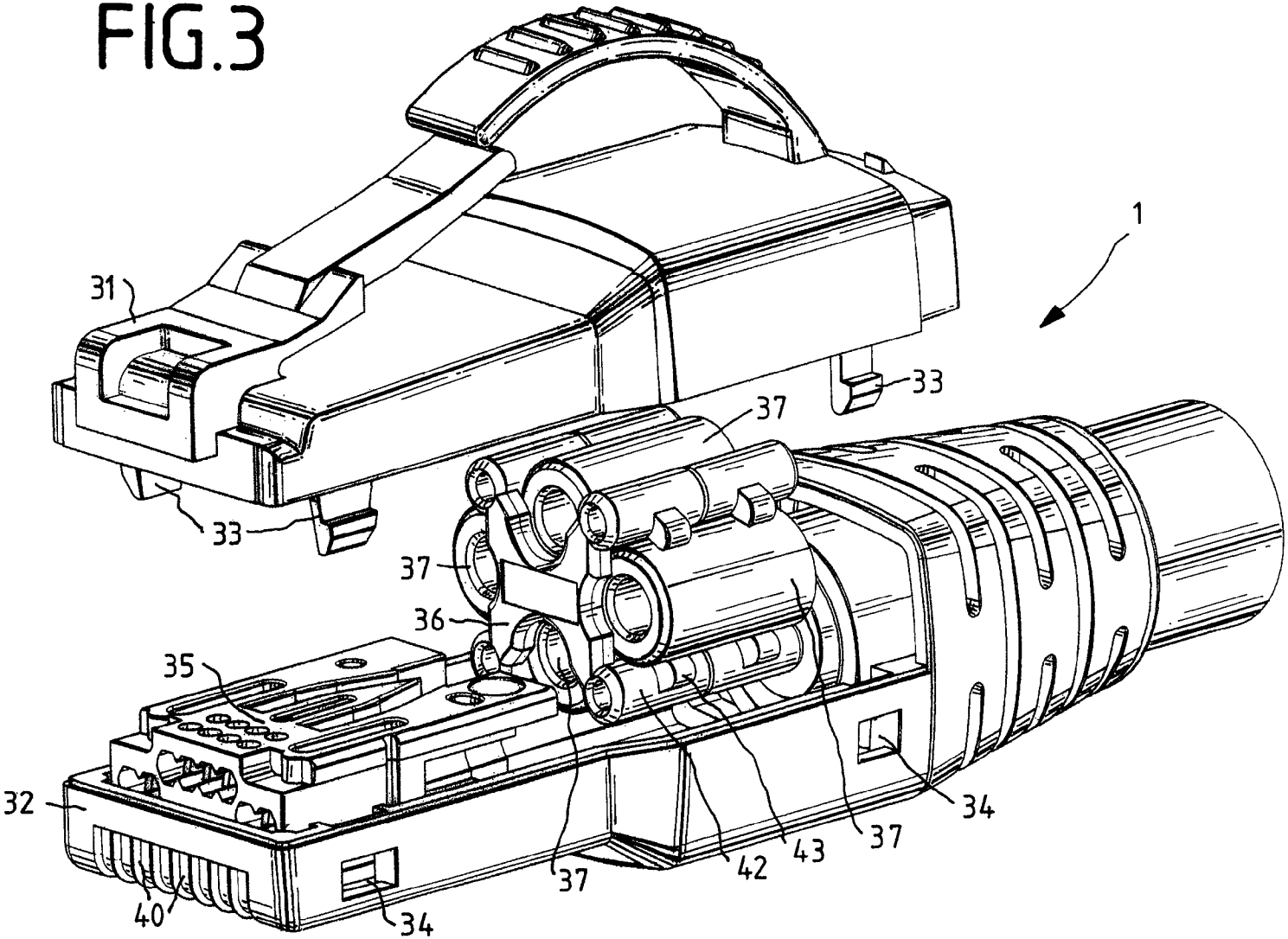
FIG. 3 shows an exploded illustration of a plug-in connector with a ferrite sleeve holder.

FIG. 3 shows an alternative plug-in connector 1 in the form of a plug, the plug-in connector housing having a two-part design and comprising an upper part 31 and a lower part 32, which can be latched to one another. For this purpose, the upper part 31 is formed with latching hooks 33, which engage in latching openings 34 in the lower part 32. A cable manager 35 is arranged in the lower part 32 and ensures defined guidance of the cores 28 of a data cable 50 to first contacts 29, which are coupled to the RF contacts 30 of the plug. Arranged behind the cable manager 35 is a ferrite sleeve holder 36, which is used for holding four ferrite sleeves 37. The cores 28 to be connected are in this case guided in pairs through the ferrite sleeve 37 and then in the cable manager 35. The ferrite sleeve holder 36 is in this case designed such that the four ferrite sleeves 37 do not come into contact with one another, with the result that feedback of magnetic currents is avoided. The ferrite sleeve holder 36 is in this case not fixed separately to the housing, but is held by the cores 28 or upper and lower parts 31, 32 pressing on one another. The ferrite sleeve holder 36 preferably consists of plastic.

Figure 4:
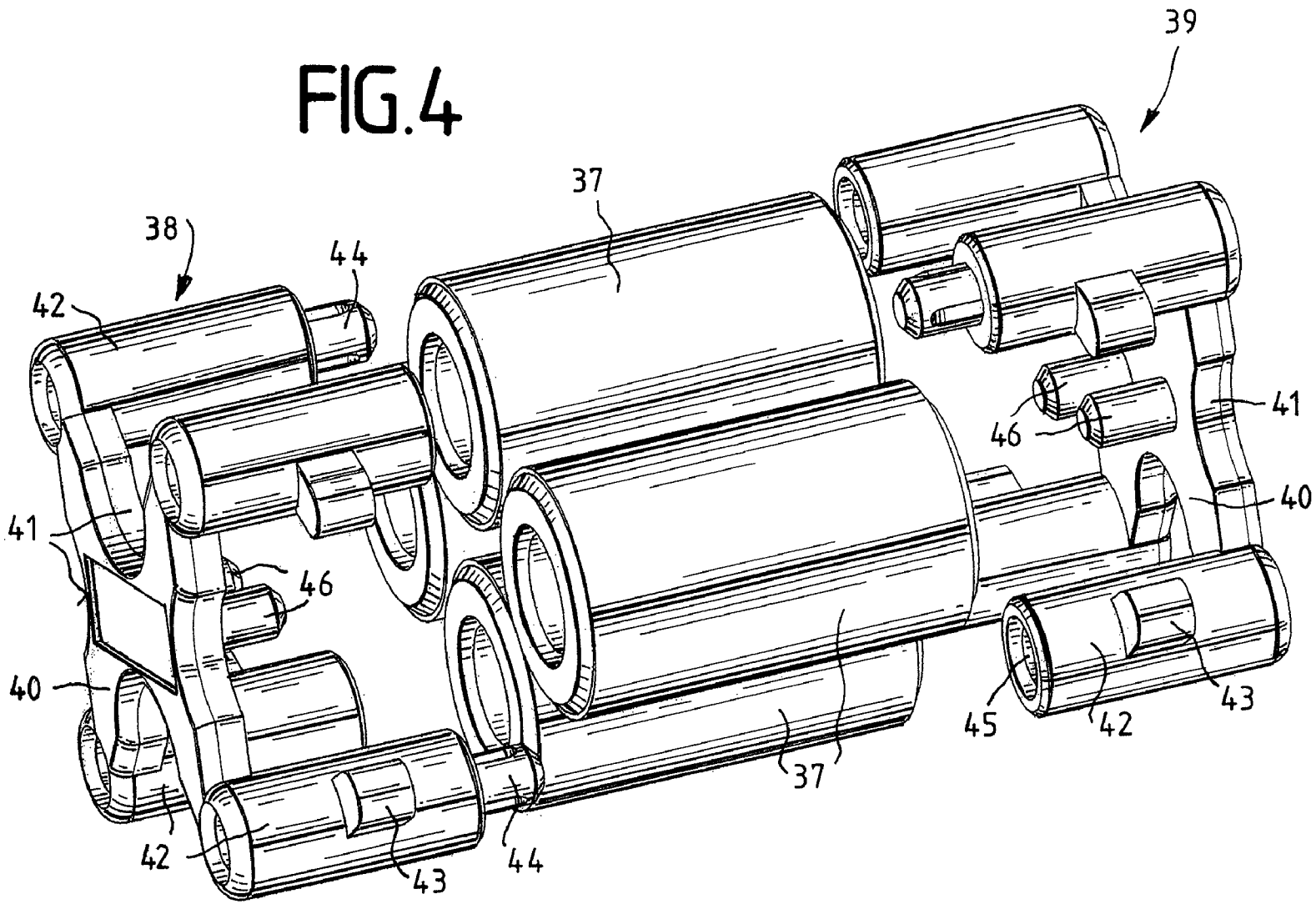
FIG. 4 shows an exploded illustration of a ferrite sleeve holder with ferrite sleeves.

As can be seen in FIG. 4, the ferrite sleeve holder 36 has a two-part design and comprises a front part 38 and a rear part 39. The front part 38 comprises a base body 40, which has bays 41, in each case offset through 90° with respect to one another. These bays 41 accommodate the ferrite sleeves 37. Furthermore, the base body 40 has cylindrical attachments 42 having clamping protrusions 43. As can be seen in FIG. 3, a ferrite sleeve 37 is fixedly clamped between four cylindrical attachments 42 with clamping protrusions 43. In this case, the front part 38 and the rear part 39 have a virtually identical design. In order to connect the front part 38 and the rear part 39 to one another, in each case two cylindrical attachments 42 have journals 44, which enter an opening 45 in the opposite cylindrical attachment 42. Furthermore, the base body 40 also has holding journals 46.

Figure 5:
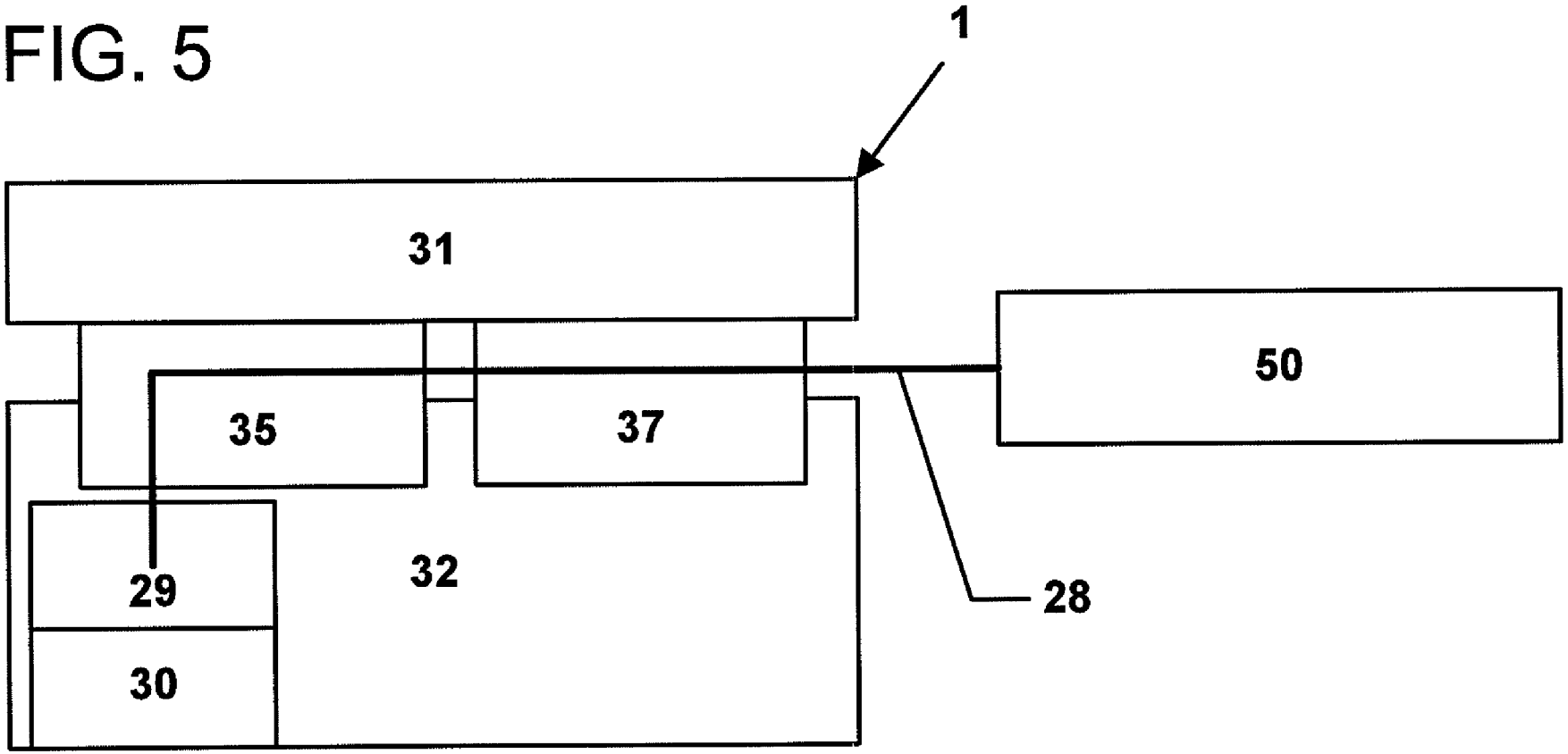
FIG. 5 is a schematic diagram of the alternative plug-in connector 1 shown in FIG. 3.

FIG. 5 shows a schematic illustration of the alternative plug-in connector 1 shown in FIG. 3. The plug-in connector 1 includes the upper housing part 31 and the lower housing part 32. The cable manager 35 is arranged in the lower part 32. Ferrite sleeves 37 are arranged behind the cable manager 35. The plug-in connector 1 also includes first contacts 29 and second, RF contacts 30. A second contact 30 corresponds to each first contact 29. The first contacts 29 are DC-connected to their corresponding second contacts 30. Contact is made with a plurality of core pairs 28 of a symmetrical data cable 50 by means of the first contacts 29. Two first contacts 29 are correspond to each core pair 28. An electrical contact is produced with contacts of a complementary plug-in connector by means of the second contacts 30. Cores 28 of the cable 50 are guided through the sleeve 37 to the manager 35 to the contacts.

LIST OF REFERENCES

1 Plug-in connector
2 Plug-in connector housing
3 Printed circuit board
4 Retainer
5 Cable manager
6 Shielding plate
7 RF contacts
8 Insulation displacement contacts
9 Cylinder pins
10 Latching tabs
11 Openings
12 Latching hooks
14 Cylindrical attachment
17 Guide cross
20 Conductor track
21 Conductor track
22 SMD component
23 Common-mode inductor
24 Ferrite ring
25 Conductor track
26 Conductor track
30 RF contacts
31 Upper part
32 Lower part
33 Latching hooks
34 Latching openings
35 Cable manager
36 Ferrite sleeve holder
37 Ferrite sleeve
38 Front part
39 Rear part
40 Base body
41 Bays

42 Cylindrical attachments
43 Clamping protrusions
44 Journals
45 Openings
46 Holding journals

The invention claimed is:

1. A plug-in connector for telecommunications and data technology for the purpose of connecting a symmetrical data cable, the plug-in connector comprising:

an electrically insulating plug-in connector housing, and first contacts and second contacts positioned in the connector housing, the first contacts being configured to electrically connect to a plurality of core pairs of a symmetrical data cable, the second contacts being configured to electrically connect to contacts of a complementary plug-in connector, wherein two of the first contacts correspond to each core pair, and one second contact corresponds to each first contact, the first contacts being DC-connected to their corresponding second contacts, wherein one of a plurality of common-mode filter arrangements corresponds to each of the core pairs, wherein the common-mode filter arrangements are in the form of ferrite sleeves, wherein the ferrite sleeves are configured for each core pair to pass through the corresponding ferrite sleeve, wherein the plug-in connector housing includes an upper part that is configured to latch to a lower part, wherein the plug-in connector housing also includes a cable manager that is configured to guide the core pairs to the first and second contacts.

2. The plug-in connector as claimed in claim 1, wherein the ferrite sleeves are fixed as separate components to the plug-in connector housing.

3. The plug-in connector as claimed in claim 1, wherein the plug-in connector housing consists at least partially of a ferrite material or contains ferrite material.

4. The plug-in connector as claimed in claim 2, wherein the ferrite sleeves are fixed to a ferrite sleeve holder held within the plug-in connector housing.

5. The plug-in connector as claimed in claim 4, wherein the holder is configured to hold four ferrite sleeves.

6. The plug-in connector as claimed in claim 4, wherein the ferrite sleeves held by the holder do not come into contact with each other.

7. The plug-in connector as claimed in claim 4, wherein the holder is held between the upper and lower parts.

8. The plug-in connector as claimed in claim 4, wherein the holder includes a front part and a rear part.

9. The plug-in connector as claimed in claim 8, wherein the front part of the holder includes a base body defining a plurality of bays configured to retain the ferrite sleeves.

10. The plug-in connector as claimed in claim 9, wherein the base body also includes attachments with clamping protrusions that connect the front part to the rear part.

11. The plug-in connector as claimed in claim 1, wherein the plug-in connector housing forms a plug.

12. The plug-in connector as claimed in claim 1, wherein the second contacts include RJ contacts.

13. A plug-in connector for telecommunications and data technology for the purpose of connecting a symmetrical data cable, the plug-in connector comprising:

an electrically insulating plug-in connector housing, and first contacts and second contacts positioned in the connector housing, the first contacts being configured to electrically connect to a plurality of core pairs of a symmetrical data cable, the second contacts being configured to electrically connect to contacts of a complementary plug-in connector, wherein two of the first contacts correspond to each core pair, and one second contact corresponds to each first contact, the first contacts being DC-connected to their corresponding second contacts, wherein one of a plurality of common-mode filter arrangements corresponds to each of the core pairs, wherein the common-mode filter arrangements are in the form of ferrite sleeves, wherein the ferrite sleeves are configured for each core pair to pass through the corresponding ferrite sleeve, wherein the ferrite sleeves are fixed as separate components to the plug-in connector housing, and wherein the ferrite sleeves are fixed to a ferrite sleeve holder held within the plug-in connector housing.

14. The plug-in connector as claimed in claim 13, wherein the holder is configured to hold four ferrite sleeves.

15. The plug-in connector as claimed in claim 13, wherein the ferrite sleeves held by the holder do not come into contact with each other.

16. The plug-in connector as claimed in claim 13, wherein the plug-in connector housing includes an upper part that is configured to latch to a lower part, and wherein the holder is held between the upper and lower parts.

17. The plug-in connector as claimed in claim 13, wherein the holder includes a front part and a rear part.

18. The plug-in connector as claimed in claim 17, wherein the front part of the holder includes a base body defining a plurality of bays configured to retain the ferrite sleeves.

19. The plug-in connector as claimed in claim 18, wherein the base body also includes attachments with clamping protrusions that connect the front part to the rear part.

* * * * *